US010610759B2

(12) United States Patent
Hsu

(10) Patent No.: US 10,610,759 B2
(45) Date of Patent: Apr. 7, 2020

(54) BICYCLE TRAINER

(71) Applicant: Giant Manufacturing Co., Ltd., Taichung (TW)

(72) Inventor: Hsaio-Wen Hsu, Taichung (TW)

(73) Assignee: Giant Manufacturing Co., Ltd., Taichung (TW)

( * ) Notice: Subject to any disclaimer, the term of this patent is extended or adjusted under 35 U.S.C. 154(b) by 205 days.

(21) Appl. No.: 14/614,363

(22) Filed: Feb. 4, 2015

(65) Prior Publication Data

US 2016/0101337 A1 Apr. 14, 2016

(30) Foreign Application Priority Data

Oct. 14, 2014 (TW) ..... 103135516 A

(51) Int. Cl.

| | |
|---|---|
| ***A63B 69/16*** | (2006.01) |
| ***A63B 21/22*** | (2006.01) |
| ***A63B 21/005*** | (2006.01) |
| ***A63B 23/04*** | (2006.01) |

(52) U.S. Cl.

CPC ..... *A63B 69/16* (2013.01); *A63B 21/0051* (2013.01); *A63B 21/22* (2013.01); *A63B 23/0476* (2013.01); *A63B 2069/165* (2013.01); *A63B 2069/168* (2013.01)

(58) Field of Classification Search

CPC ..... A63B 69/16; A63B 23/0476; A63B 2069/163; A63B 2069/164; A63B 2069/165; A63B 2069/167; A63B 21/0051; A63B 21/0056; A63B 21/02; A63B 21/021; A63B 21/022; A63B 2069/162; A63B 2069/166; A63B 21/005–0059; A63B 2069/161–168

See application file for complete search history.

(56) References Cited

U.S. PATENT DOCUMENTS

| | | | | |
|---|---|---|---|---|
| 4,789,153 A | | 12/1988 | Brown | |
| 4,826,150 A | | 5/1989 | Minoura | |
| 4,898,379 A | * | 2/1990 | Shiba | A63B 21/0051 482/61 |

(Continued)

FOREIGN PATENT DOCUMENTS

| | | |
|---|---|---|
| CN | 1986020 | 6/2007 |
| CN | 102078675 | 6/2011 |

(Continued)

OTHER PUBLICATIONS

"Office Action of Taiwan Counterpart Application," dated Jul. 28, 2015, p. 1-p. 4, in which the listed references were cited.

(Continued)

*Primary Examiner* — Nyca T Nguyen
(74) *Attorney, Agent, or Firm* — JCIPRNET

(57) ABSTRACT

A bicycle trainer is adapted to be arranged with a bicycle to simulate riding a bicycle on an outdoor road. The bicycle includes a stand, a roller and a resistance source. The stand is adapted to support the bicycle. The roller is pivoted to the stand and adapted to contact a bicycle wheel of the bicycle. The resistance source is coupled to the roller and provides resistance to the bicycle wheel via the roller. The resistance source varies the magnitude of the provided resistance according to the rotation speed of the roller.

5 Claims, 10 Drawing Sheets

(56) References Cited

U.S. PATENT DOCUMENTS 5,477,093 A * 12/1995 Lamb ..... H02K 49/046 310/75 D
5,656,001 A 8/1997 Baatz
5,728,029 A * 3/1998 Minoura ..... A63B 21/0051 482/61
5,879,273 A * 3/1999 Wei ..... A63B 21/0051 188/164
6,736,761 B2 * 5/2004 Huang ..... A63B 21/0051 482/57
7,011,607 B2 * 3/2006 Kolda ..... A63B 21/0051 482/57
7,101,320 B2 * 9/2006 Qiu ..... A63B 21/0051 482/57
7,438,672 B1 * 10/2008 Rylander ..... A63B 22/0605 446/396
7,462,140 B1 * 12/2008 Lombardozzi ..... A63B 5/20 482/108
8,061,697 B1 * 11/2011 Lee ..... B60G 11/14 188/290
2003/0027692 A1 * 2/2003 Phillips ..... A63B 21/015 482/57
2003/0134725 A1 * 7/2003 Kim ..... A63B 21/00043 482/106
2003/0216225 A1 * 11/2003 Pan ..... A63B 22/02 482/54
2005/0064999 A1 3/2005 Qiu
2006/0252616 A1 * 11/2006 Gerschefske ..... A63B 5/00 482/142
2007/0167295 A1 * 7/2007 Chen ..... A63B 21/0051 482/63
2010/0317493 A1 * 12/2010 Chen ..... A63B 69/16 482/61
2012/0228906 A1 * 9/2012 McAndrews ..... B62J 1/08 297/215.13
2012/0322621 A1 12/2012 Bingham, Jr. et al.
2014/0162852 A1 * 6/2014 Ho ..... A63B 21/023 482/127
2014/0256521 A1 * 9/2014 Davies, III ..... A63B 21/0728 482/107

FOREIGN PATENT DOCUMENTS

TW M294344 7/2006
TW I273915 2/2007
TW 201043299 12/2010
TW 201410298 3/2014
WO 2006102529 9/2006

OTHER PUBLICATIONS

"Office Action of Europe Counterpart Application", dated Mar. 2, 2016, p. 1-p. 9, in which the listed references were cited.
"Office Action of China Counterpart Application," dated Nov. 6, 2017, p. 1-p. 5, in which the listed references were cited.

* cited by examiner

BICYCLE TRAINER

CROSS-REFERENCE TO RELATED APPLICATION

This application claims the priority benefit of Taiwan application serial no. 103135516, filed on Oct. 14, 2014. The entirety of the above-mentioned patent application is hereby incorporated by reference herein and made a part of this specification.

BACKGROUND OF THE INVENTION

1. Field of the Invention

The invention relates to a bicycle, and particularly relates to a bicycle trainer.

2. Description of Related Art

When unable to perform training on an outdoor road due to weather conditions, bicycle cyclists or enthusiasts may use a bicycle arranged with a bicycle trainer to simulate riding on an outdoor road. When riding a bicycle on an outdoor road, the resistance a rider needs to overcome include the road surface resistance, the tire rolling resistance and the wind resistance. Under the same road surface and the same bicycle conditions, the road surface resistance and the tire rolling resistance may be thought of as being constant fixed values, whereas the wind resistance will be proportional to the speed squared. If the total resistance needed to be overcome is substituted using the power needed, then the change in a normal speed power curve for riding outdoors may be represented by a concave curve. However, the change in the speed power curve for bicycle trainers currently on the market typically are those of straight lines, and are not able to simulate the true feeling of riding outdoors, or although the change in the speed power curve is a concave curve, however it is not able to actually follow the normal speed power curve for riding outdoors from the beginning to the end.

SUMMARY OF THE INVENTION

The invention provides a bicycle trainer, adapted to be arranged with a bicycle to simulate riding a bicycle on an outdoor road.

A bicycle trainer of the invention is adapted to be arranged with a bicycle to simulate riding a bicycle on an outdoor road. The bicycle trainer includes a stand, a roller and a resistance source. The stand is adapted to support the bicycle. The roller is pivoted to the stand and adapted to contact a bicycle wheel of the bicycle. The resistance source is coupled to the roller, providing resistance to the bicycle wheel via the roller. The resistance source varies the magnitude of the provided resistance according to a rotation speed of the roller. In an embodiment, the resistance source may provide a power speed curve having at least two stages.

According to the above, in the invention, the resistance source may vary the magnitude of the provided resistance according to a rotation speed of the roller, and may provide a power speed curve having at least two stages, to be approximately in line with that of the curve of the normal speed power curve for riding outdoors, therefore improving on the disadvantage of the conventional simple power speed curve which are only able to be partially in line with the normal speed power curve for riding outdoors, allowing the rider to experience a true feeling of riding outdoors.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
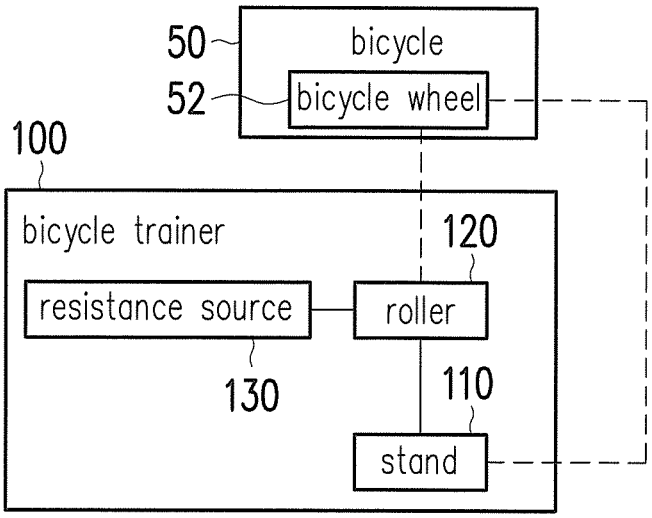
FIG. 1 is a block diagram illustrating a bicycle trainer according to an embodiment of the invention

Reference will now be made in detail to the present preferred embodiments of the invention, examples of which are illustrated in the accompanying drawings. Wherever possible, the same reference numbers are used in the drawings and the description to refer to the same or like parts.

Figure 2:
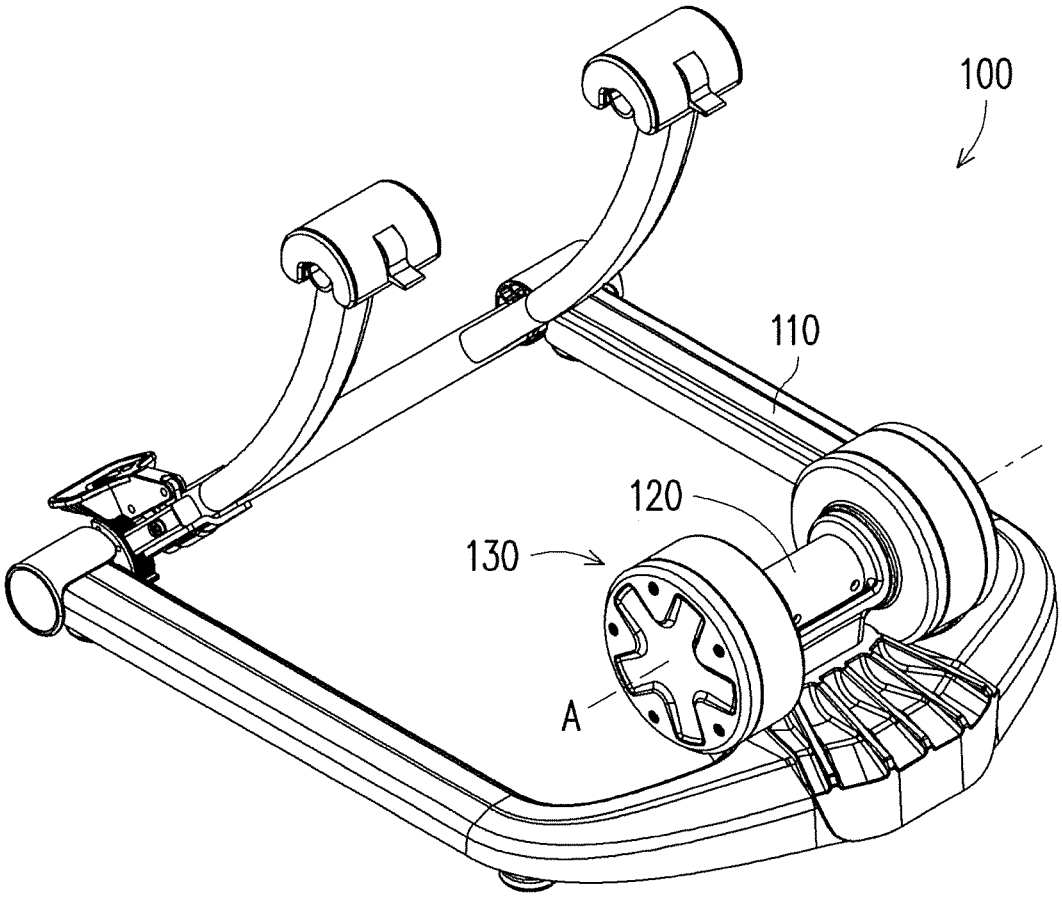
FIG. 2 is a three dimensional view illustrating the bicycle trainer of FIG. 1.
Figure 3:
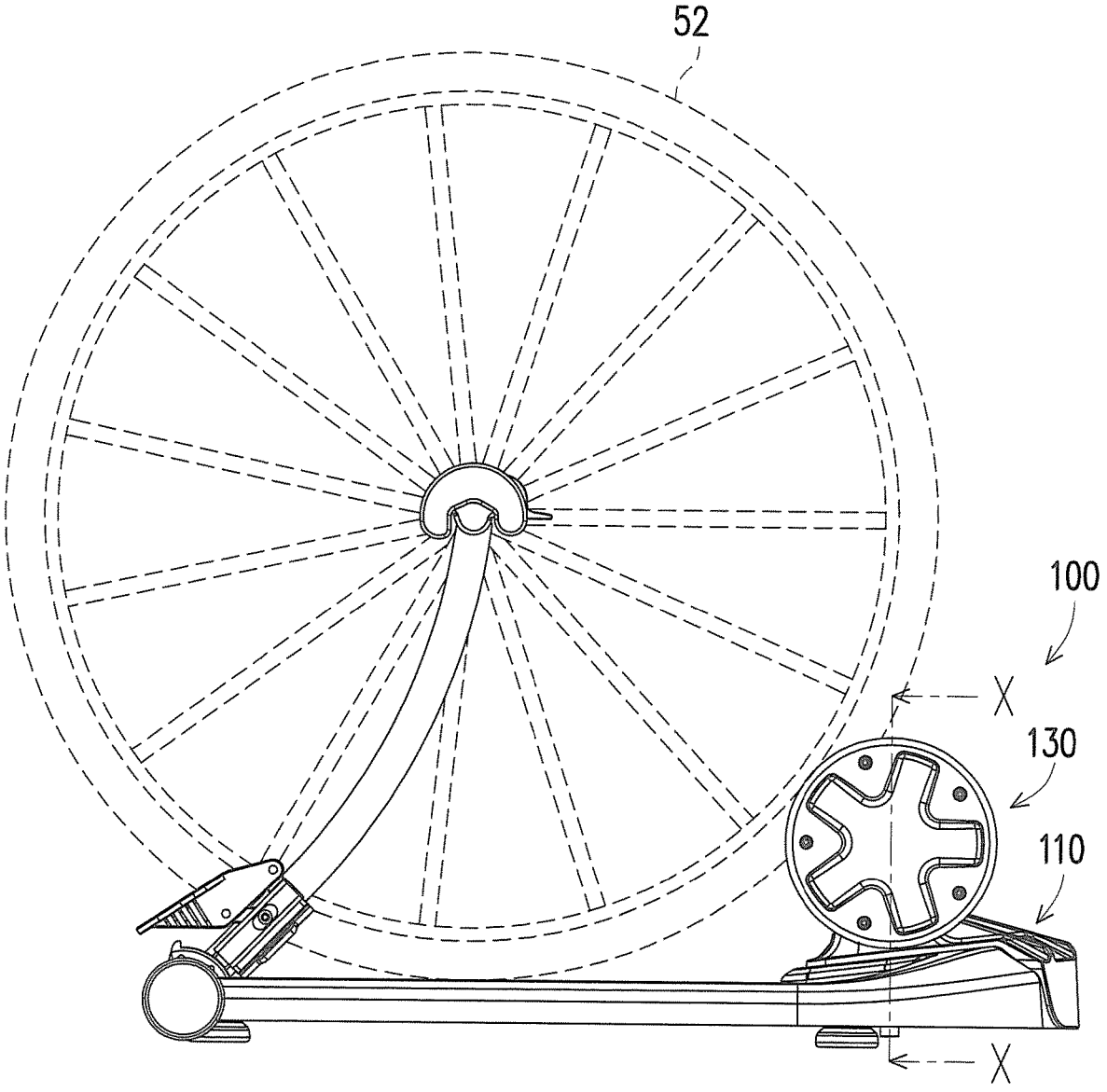
FIG. 3 is a side view illustrating the bicycle trainer of FIG. 2.

Referring to FIG. 1, FIG. 2, FIG. 3, in the present embodiment, a bicycle trainer 100 is adapted to be arranged with a bicycle 50 to simulate riding a bicycle on an outdoor road. The bicycle 100 includes a stand 110, a roller 120 and a resistance source 130. The stand 110 is adapted to support the bicycle 50, and particularly to support a bicycle wheel 52 of the bicycle 50. The roller 120 is pivoted to the stand 110 on an axis A and adapted to contact a bicycle wheel 52 of the bicycle 50. The resistance source 130 is coupled to the roller 120 and provides resistance to the bicycle wheel 52 via the roller 120. The resistance source 130 may vary the magnitude of the provided resistance according to the rotation speed of the roller 120.

Figure 4A:
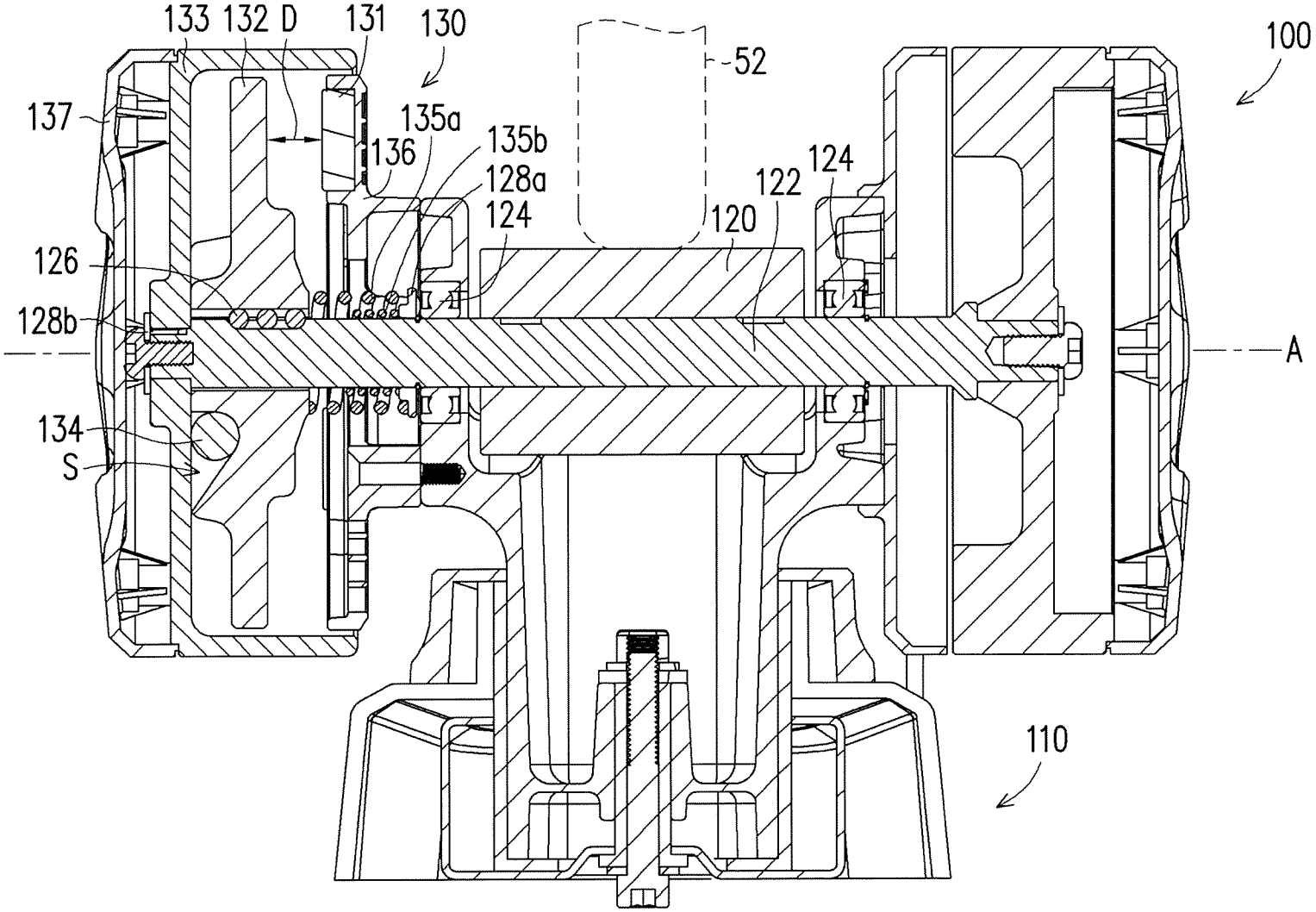
FIG. 4A is a partial cross-sectional view illustrating the bicycle trainer of FIG. 3 in a resting state along the line X-X.

Referring to FIG. 2, FIG. 3 and FIG. 4A, in the present embodiment, the resistance source 130 uses the eddy current effect to produce magnetic resistance. More specifically, the resistance source 130 may include a magnetic fixing component 131 and a non-magnetic metal rotating component 132. The magnetic fixing component 131 is fixed to the stand 110. The roller 120 is coupled to a rotation axis 122, the rotation axis 122 is pivoted to the stand 110 through a plurality of bearings 124, and the non-magnetic metal rotating component 132 is coupled to the roller 120 through the rotation axis 122. The rotating non-magnetic metal rotating component 132 and the magnetic fixing component 131 mutually interact producing a magnetic resistance, and is provided to the roller 120. In the present embodiment, the magnetic fixing component 131 is a magnetic component 131*a* (magnet, for example), and the non-magnetic metal rotating component 132 may be a magnetism sensing flywheel (flywheel of zinc alloy, aluminum alloy, copper alloy, or stainless steel material, for example).

Figure 4B:
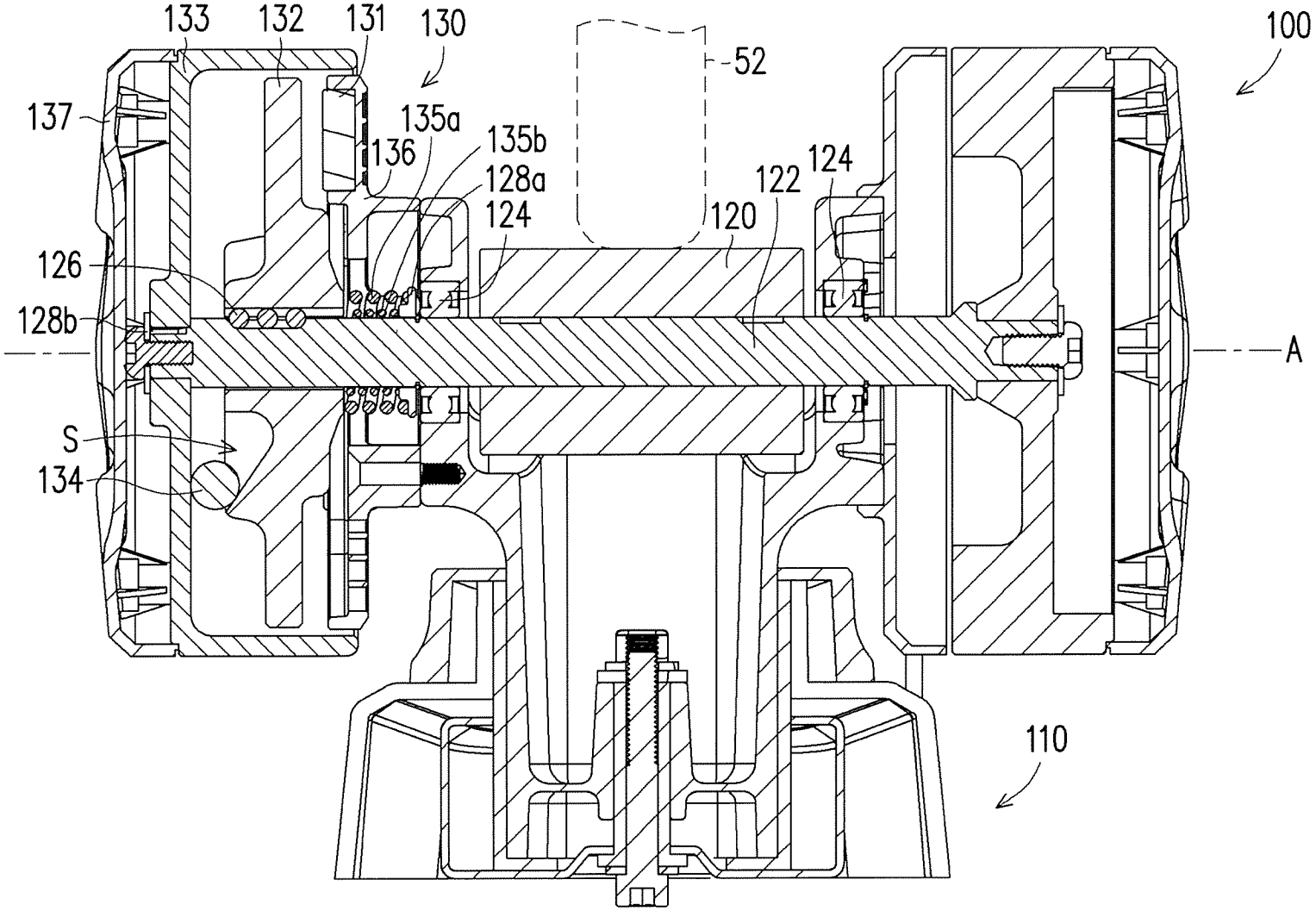
FIG. 4B is a partial cross-sectional view illustrating the bicycle trainer of FIG. 4A in a first active state.

Referring to FIG. 4A and FIG. 4B, in the present embodiment, in order to allow the resistance source 130 to vary the provided resistance according to the rotation speed of the roller 120 (namely bicycle wheel 52), the resistance source 130 may further include a restrictive rotating component 133 and a plurality of rolling components 134 (for example, a plurality of balls). The restrictive rotating component 133 may be coupled to the roller 120 through the rotation axis 122, and construes a plurality of paths S with the non-magnetic metal rotating component 132. The rolling components 134 are respectively located in the paths S. When the rotation speed of the non-magnetic metal rotating component 132 and the restrictive rotating component 133 increases, the rolling components 134 move along the paths S due to the influence of centrifugal force, allowing the non-magnetic metal rotating component 132 to move with respect to the magnetic fixing component 131, to adjust an interacting distance D between the magnetic fixing component 131 and the non-magnetic metal rotating component 132. It should be noted, the magnetic resistance produced by the eddy current effect is inversely proportional to the interacting distance D squared. The smaller the interacting distance D, the larger the magnetic resistance produced by the mutual interaction of the magnetic fixing component 131 and the non-magnetic metal rotating component 132, as shown in FIG. 4B.

Referring to FIG. 4A and FIG. 4B, in the present embodiment, a plurality of rolling components 126 (balls, for example) are arranged between the non-magnetic metal rotating component 132 and the rotation axis 122. The rolling components 126 are linearly arranged at the periphery of the rotation axis 122, and respectively located in particular grooves, to set the moving direction of the non-magnetic metal rotating component 132 with respect to the rotation axis 122.

Referring to FIG. 4A, the resistance source 130 may further include a restoring component. The restoring component having a compression spring 135*a* and another compression spring 135*b*. The compression spring 135*a* may exert a restoring force to the non-magnetic metal rotating component 132 with respect to the magnetic fixing component 131, and altering the magnitude of the restoring force exerted according to a change in the interaction distance D between the magnetic fixing component 131 and the non-magnetic metal rotating component 132. In the present embodiment, the compression spring 135*a* and the compression spring 135*b* are compression springs and have varying free lengths, wherein the compression spring 135*a* has a larger free length, and the compression spring 135*b* has a smaller free length. The compression spring 135*a* and the compression spring 135*b* also have differing elastic coefficients (namely, K value). In the present embodiment, an inner stop ring 128*a* and an outer stop ring 128*b* are arranged on the rotation axis 122 to set the movable range of the non-magnetic metal rotating component 132, the restrictive rotating component 133, the compression spring 135*a* and the compression spring 135*b* with respect to the rotation axis 122. In the present embodiment, the compression spring 135*a* also may provide a restoring function, and the compression spring 135*a* may restore the non-magnetic metal rotating component 132. When the rotation speed of the non-magnetic metal rotating component 132 and the restrictive rotating component 133 decreases, the compression spring 135*a* restores the non-magnetic metal rotating component 132, to increase the interacting distance D between the non-magnetic metal rotating component 132 and the magnetic fixing component 131, as shown in FIG. 4A.

Referring to FIG. 4B, when the rotation speed of the non-magnetic metal rotating component 132 and the restrictive rotating component 133 increases, the rolling components 134 respectively move along the paths S due to the influence of centrifugal force, allowing the non-magnetic metal rotating component 132 to move with respect to the magnetic fixing component 131, compressing the compression spring 135*a*. The compression spring 135*a* under compression provides a restoring force to the non-magnetic metal rotating component 132 with respect to the magnetic fixing component 131.

Figure 4C:
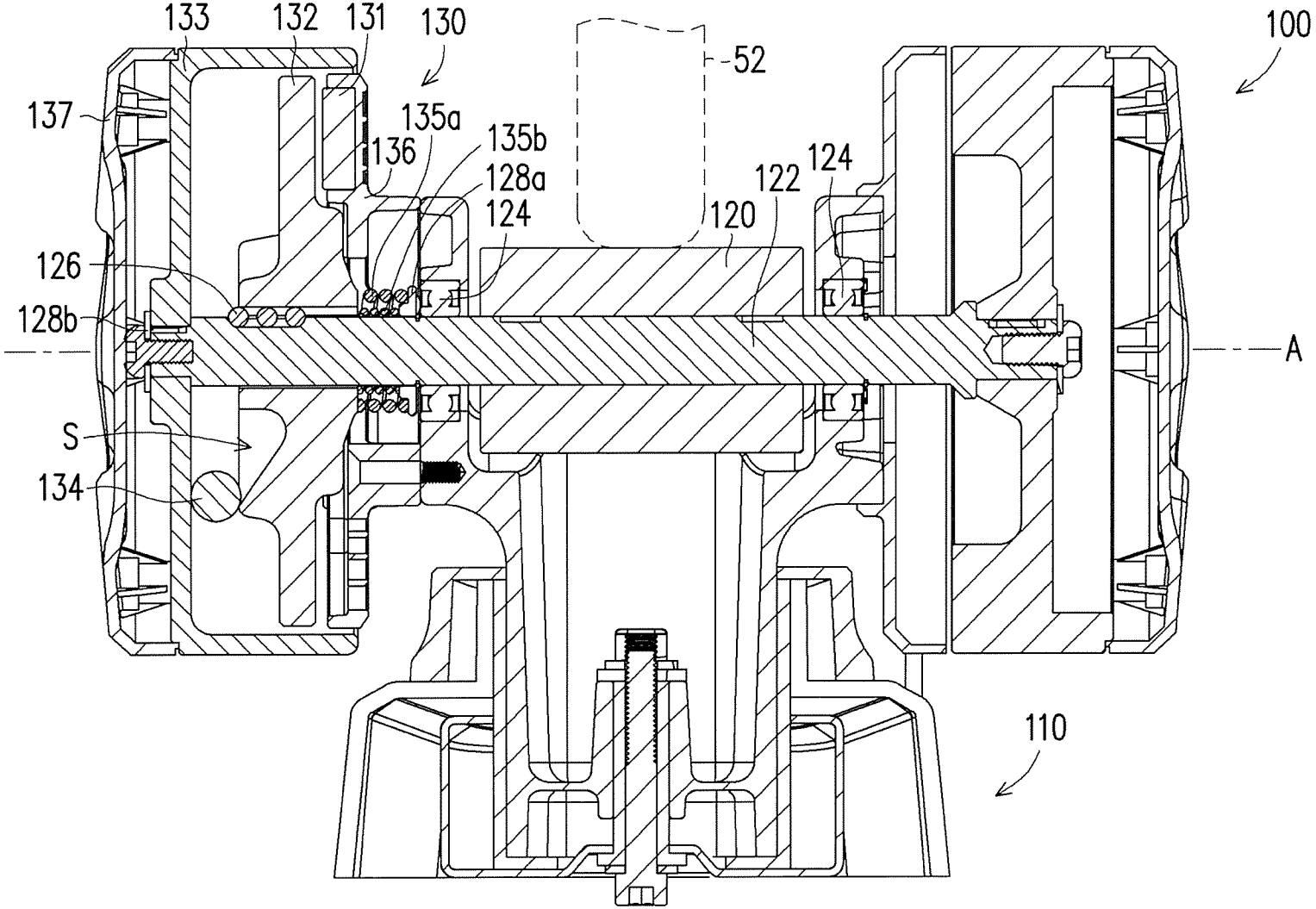
FIG. 4C is a partial cross-sectional view illustrating the bicycle trainer of FIG. 4A in a second active state.

Referring to FIG. 4C, when the rotation speed of the non-magnetic metal rotating component 132 and the restrictive rotating component 133 continue to increase, the non-magnetic metal rotating component 132 continues to move with respect to the magnetic fixing component 131, and the rolling components 134 continue to respectively move along the paths S due to the influence of centrifugal force, allowing the non-magnetic metal rotating component 132 to continue to move with respect to the magnetic fixing component 131, compressing the compression spring 135*a* and the compression spring 135*b*. The compression spring 135*a* and the compression spring 135*b* under compression provide a restoring force to the non-magnetic metal rotating component 132 with respect to the magnetic fixing component 131 at the same time.

Figure 5:
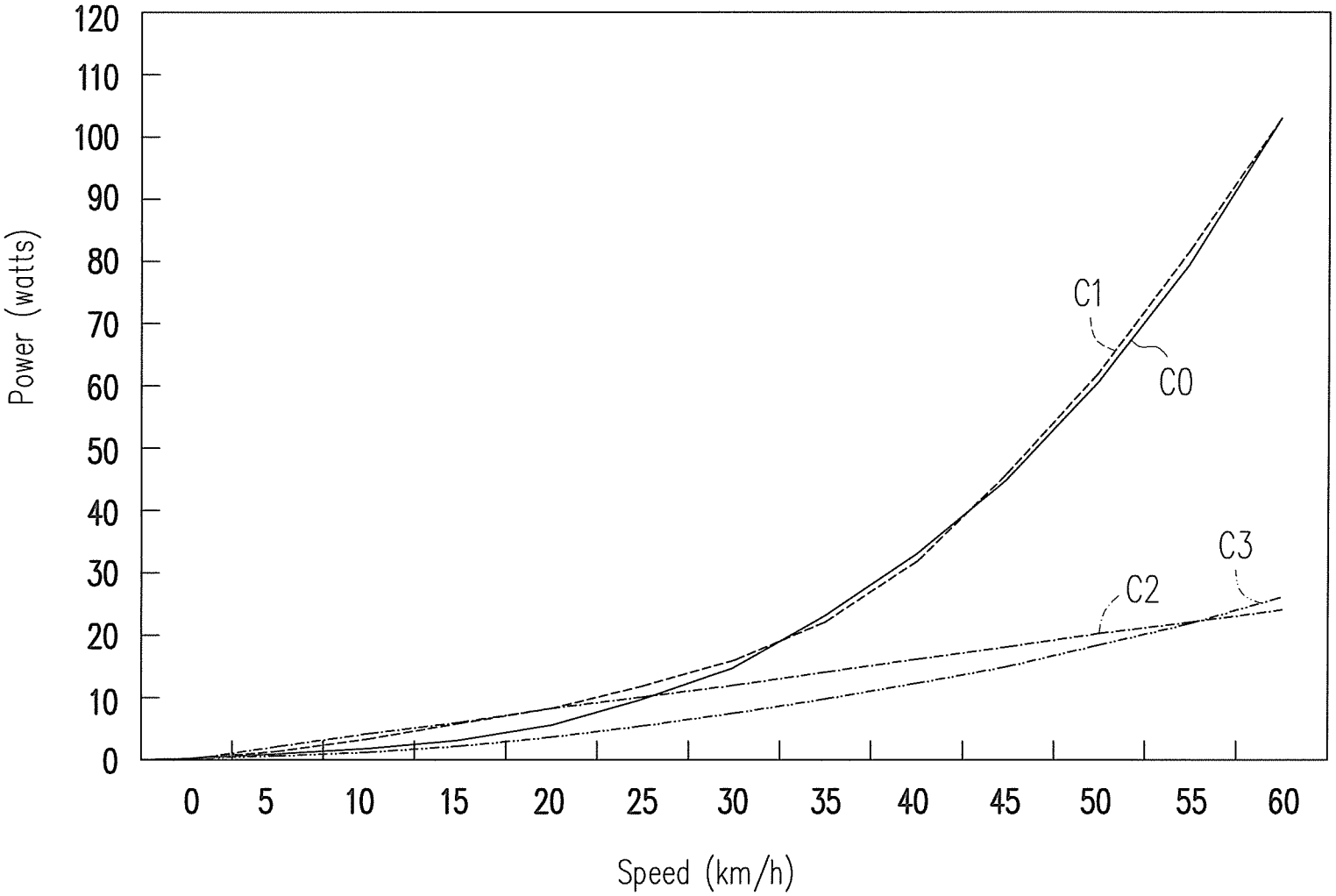
FIG. 5 is a comparison graph illustrating a curve line of the power needed of riding outdoors relative to speed of the bicycle trainer of FIG. 3.

Referring to FIG. 4A and FIG. 5, in the present embodiment, when the compression spring 135*a* has a free length of 25.5 mm and a spring coefficient of 1.3 kgf/mm, and a preload value of 1 mm, and the compression spring 135*b* has a free length of 17 mm and a spring coefficient of 0.55 kgf/mm, the speed power curve of the bicycle trainer 100 is shown in the curve C1. In the present embodiment, in a former stage of the curve C1 of the speed power curve of the bicycle trainer is in a former speed range and only affected by the compression spring 135*a*, however in a latter stage of the curve C1 of the speed power curve of the bicycle trainer is in a latter speed range, followed by the former speed range, and affected by the compression spring 135*a* and the compression spring 135*b* at the same time. By this setting, the curve C1 of the speed power curve of the bicycle trainer of the present embodiment has at least two stages according to the change in speed, a former stage and a latter stage, for example. Here, a plurality of stages of a speed power curve of a bicycle trainer means a plurality of power variations in a plurality of speed ranges respectively, and the speed ranges are continuous in sequence. Regarding a curve C2 of the speed power curve of a conventional bicycle trainer or a curve C3 of the speed power curve of another conventional bicycle trainer, the former stages of the two are approximately in line with that of the curve C0 of the normal speed power curve for riding outdoors, however the latter stages of the two completely deviate from that of the curve C0 of the normal speed power curve for riding outdoors. Compared with the aforementioned curves C2 and C3, every stage in the curve C1 of the speed power curve of the bicycle trainer of the present embodiment are approximately in line with that of the curve C0 of the normal speed power curve for riding outdoors.

In the present embodiment, a restoring force having differing stages of magnitude may be produced when a plurality of compression springs of differing free lengths and differing K values are sequentially compressed, to adjust the magnetic resistance produced by the mutual interaction of the magnetic fixing component and the non-magnetic metal rotating component according to the change in rotation speed of the roller, allowing the resistance source to provide a speed power curve having many stages, to be approximately in line with the curve of the normal speed power curve for riding outdoors.

Referring to FIG. 4A, in the present embodiment, the resistance source 130 may further include an inner cover 136. The inner cover 136 is fixed to the stand 110, and the magnetic fixing component 131 is fixed to the inner cover 136, mutually interacting with the non-magnetic metal rotating component 132 to produce a magnetic resistance. The resistance source 130 may further include an outer cover 137. The outer cover 137 is fixed to the restrictive rotating component 133, and rotates together with the restrictive rotating component 133, the non-magnetic metal rotating component 132 and the rotation axis 122.

Figure 6:
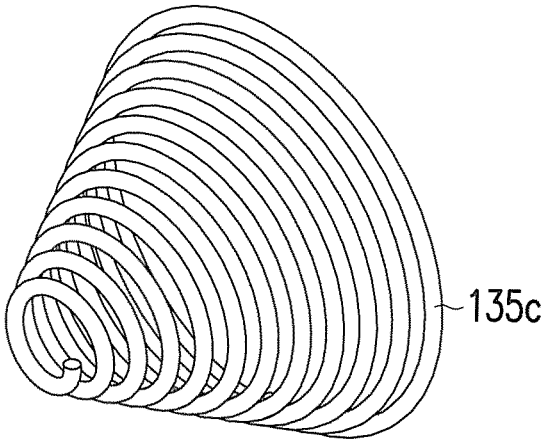
FIG. 6 is a schematic view illustrating a restoring component of the bicycle trainer according to another embodiment of the invention.

The compression spring 135*a* and the compression spring 135*b* of FIG. 4A may also be substituted by a helical spring 135*c* of FIG. 6. It should be noted, the coil diameter of the helical spring 135*c* of FIG. 6 varies according to the length of the helical spring 135*c*. Therefore, when the helical spring 135*c* is compressed to differing lengths, a spring force of differing magnitude is produced to act as the restoring force.

Figure 7:
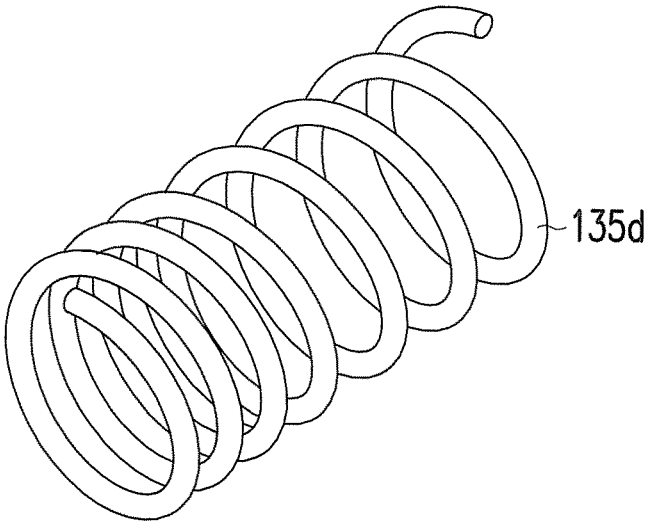
FIG. 7 is a schematic view illustrating a restoring component of the bicycle trainer according to another embodiment of the invention.

The compression spring 135*a* and the compression spring 135*b* of FIG. 4A may also be substituted by a helical spring 135*d* of FIG. 7. It should be noted, the coil spacing of the helical spring 135*d* of FIG. 7 varies according to the length of the helical spring 135*d*. Therefore, when the helical spring 135*d* is compressed to differing lengths, a spring force of differing magnitude is produced to act as the restoring force.

The compression spring 135*a* and the compression spring 135 *b* of FIG. 4A may also be substituted by a pair of magnetic components 135*e*. It should be noted, the magnetic strength of the pair of magnetic components 135*e* varies according to the distance of the pair of magnetic components 135*e*. Therefore, when the pair of magnetic components are compressed to differing lengths, a spring force of differing magnitude is produced to act as the restoring force.

Figure 8:
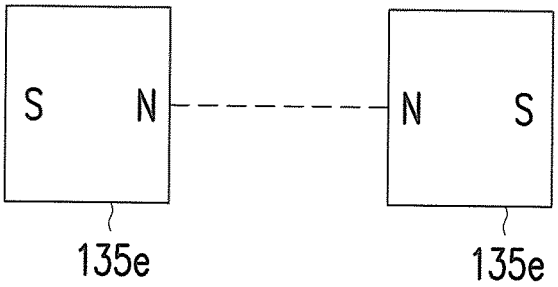
FIG. 8 is a schematic view illustrating a restoring component of the bicycle trainer according to another embodiment of the invention.
Figure 9A:
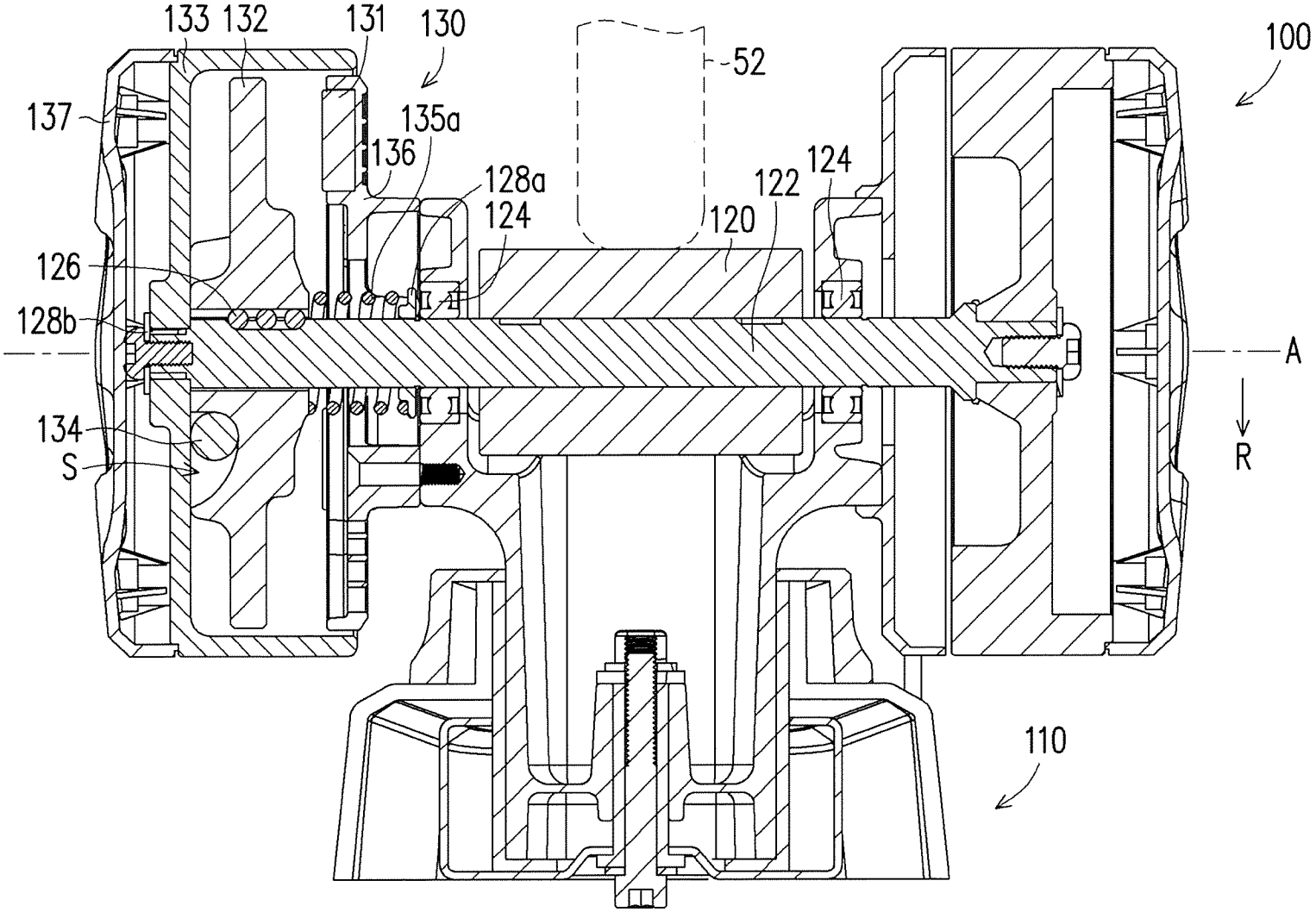
FIG. 9A is a partial cross-sectional view illustrating a bicycle trainer in a resting state according to another embodiment of the invention.
Figure 9B:
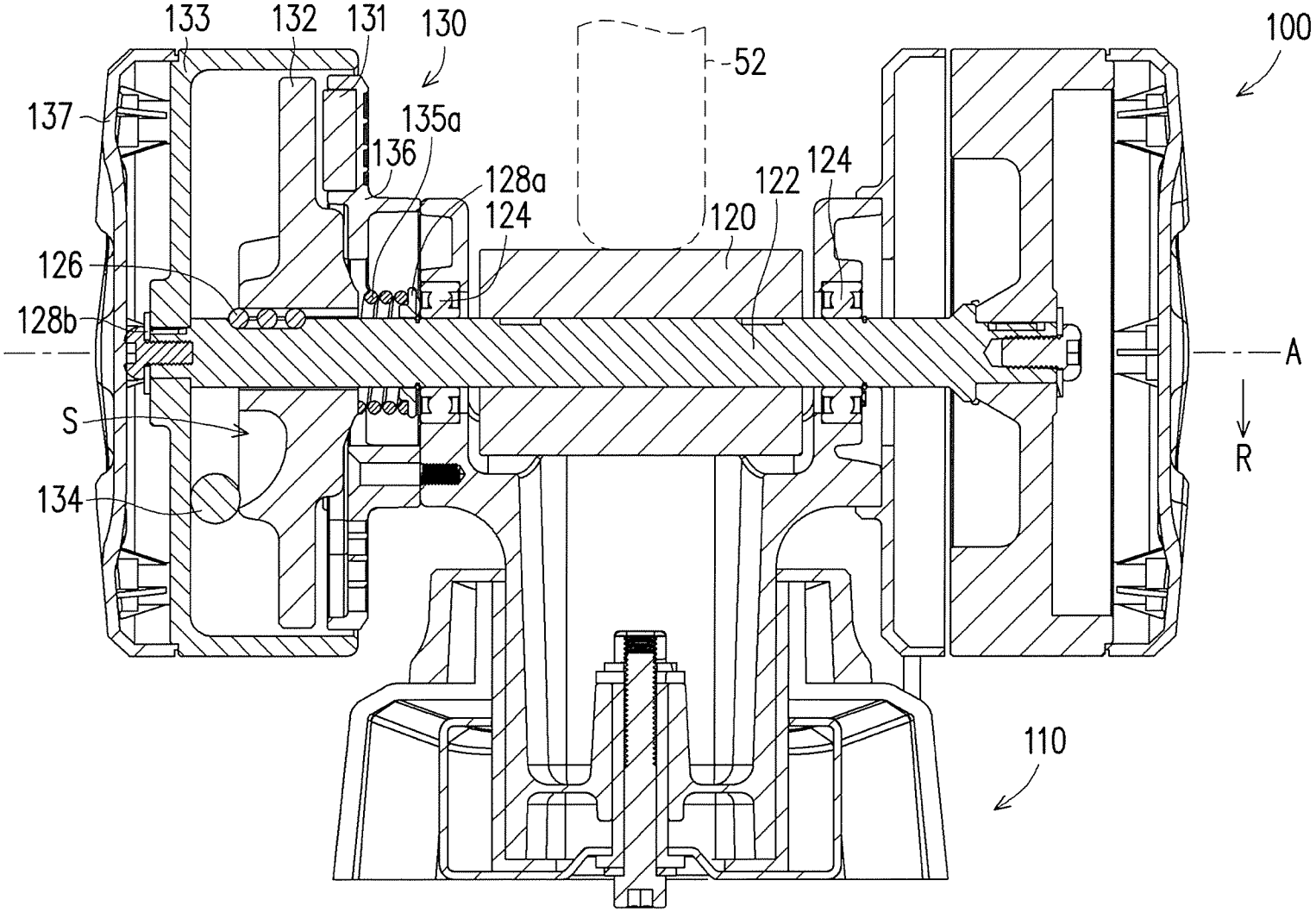
FIG. 9B is a partial cross-sectional view illustrating the bicycle trainer of 9A in an active state.

Referring to FIG. 9A and FIG. 8B, in addition to adjusting the magnetic resistance produced by the mutual interaction between the non-magnetic metal rotating component 132 and the magnetic fixing component 131 to provide a restoring force of variable magnitude according to the change in rotation speed of the roller 120 using the restoring force (compression spring 135*a* and compression spring 135*b*) of FIG. 4A, the curvature change of the plurality of paths S construed by the non-magnetic metal rotating component 132 and the restrictive rotating component 133 may also be used to correspond to a change in magnetic resistance produced by the mutual interaction between the non-magnetic metal rotating component 132 and the magnetic fixing component 131. More specifically, the power needed to be provided by the bicycle trainer 100 for all speeds may be obtained based on the curve of the normal speed power curve for riding outdoors. Therefore, the rotation speed of the roller 120 is calculated by the speed, to then calculate the centrifugal force of the rolling component 134. In addition, the resistance which the bicycle trainer 100 needs to provide is calculated from the power needed to be provided for the particular speed, which is the resistance produced by the mutual interaction between the non-magnetic metal rotating component 132 and the magnetic fixing component 131, and may have other resistance added. Lastly, under the circumstances where the centrifugal forces of the rolling component corresponding to all speeds are known, the change in curvature of the paths S in a radial direction R perpendicular to the axis A for all speeds may be calculated. Therefore, the curvature change of the paths S may be a concave curve, in which the curvature increases moving outwards.

In summary, in the invention, the restoring component may be used to provide a restoring force with many differing stages of magnitude or a restoring force of variable magnitude to adjust the resistance produced by the mutual interaction of the non-magnetic metal rotating component and the magnetic fixing component, allowing the speed power curve for the bicycle trainer to be approximately in line with that of the normal speed power curve for riding outdoors, allowing the rider to experience a true feeling of riding outdoors. The restoring component of the invention may include a plurality of elastic components with fixed K values, an elastic component with a variable K value or a pair of magnetic components to provide an auxiliary restoring force. Alternatively, the invention may adjust the magnetic resistance produced by the mutual interaction of the non-magnetic metal rotating component and the magnetic fixing component by varying the change in curvature of the paths construed by the non-magnetic metal rotating component and the restrictive rotating component, allowing the speed power curve provided by the resistance source to be approximately in line with that of the normal speed power curve for riding outdoors, allowing a rider to experience a true feeling of riding outdoors.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A bicycle trainer, adapted to be arranged with a bicycle to simulate riding the bicycle on an outdoor road, the bicycle trainer comprising:

a stand adapted to support the bicycle;

a roller pivoted to the stand and adapted to contact a bicycle wheel of the bicycle; and a resistance source coupled to the roller and providing resistance to the bicycle wheel via the roller, wherein the resistance source varies the magnitude of the provided resistance according to a rotation speed of the roller and provides a speed power curve having a plurality of stages, the resistance source comprises a plurality of elastomers for varying the magnitude of the provided resistance, each of the stages is corresponding to at least one of the elastomers, and a number of the elastomers in operation is changed in sequence along the speed power curve so that a former one of the stages is corresponding to only one of the elastomers, and a latter one of the stages is corresponding to the plurality of elastomers, wherein the elastomers of the resistance source do not contact the bicycle wheel of the bicycle.

2. The bicycle trainer as claimed in claim 1, wherein the resistance source further comprises:

a magnetic fixing component fixed to the stand;

a non-magnetic metal rotating component coupled to the roller and mutually interacting with the magnetic fixing component producing a magnetic resistance; and a restrictive rotating component coupled to the roller, wherein at least one of the elastomers exerts a restoring force to the non-magnetic metal rotating component with respect to the magnetic fixing component, and varies the magnitude of the restoring force exerted according to the change in a rotation speed of the roller so as to vary the magnitude of the produced magnetic resistance.

3. The bicycle trainer as claimed in claim 2, wherein the elastomers are a plurality of compression springs, the plurality of compression springs have differing free lengths, and a sum of a plurality of spring forces of differing magnitude, produced by the plurality of compression springs when compressed, acts as the restoring force.

4. The bicycle trainer as claimed in claim 3, wherein the plurality of compression springs have differing elastic coefficients.

5. The bicycle trainer as claimed in claim 2, wherein the restrictive rotating component constructs a plurality of paths with the non-magnetic metal rotating component, and the resistance source further comprising:

a plurality of rolling components respectively located in the plurality of paths, and respectively moving along the plurality of paths due to the influence of a centrifugal force, allowing the non-magnetic metal rotating component to move with respect to the restrictive rotating component to adjust an interacting distance between the magnetic fixing component and the non-magnetic metal rotating component.

* * * * *